United States Patent [19]

Willis

[11] 4,403,897

[45] Sep. 13, 1983

[54] SELF-CENTERING CLAMP FOR DOWN-HOLE TUBULARS

[75] Inventor: Clyde A. Willis, Wichita Falls, Tex.

[73] Assignee: Walker-Neer Manufacturing Co., Inc., Wichita Falls, Tex.

[21] Appl. No.: 182,770

[22] Filed: Aug. 29, 1980

[51] Int. Cl.[3] ..... E21B 19/14

[52] U.S. Cl. ..... 414/22; 269/32; 269/34; 269/238; 294/86 R; 294/88; 414/739; 414/741; 414/745

[58] Field of Search ..... 414/22, 739, 741, 745, 414/747; 175/52, 85; 269/32, 34, 238; 294/81 R, 86.15, 87.24, 88, 106, 115, 117, 86 R

[56] References Cited

U.S. PATENT DOCUMENTS

| | | | |
|---|---|---|---|
| 528,738 | 11/1894 | Pfouts . | |
| 1,370,251 | 3/1921 | Wilhelm . | |
| 2,816,793 | 12/1957 | Elberty | 294/115 X |
| 2,817,254 | 12/1957 | Barnes et al. | 294/115 X |
| 3,061,011 | 10/1962 | Paget . | |
| 3,145,786 | 8/1964 | O'Neill et al. . | |
| 3,156,496 | 11/1964 | Davidson | 294/115 X |
| 3,181,630 | 5/1965 | Coburn . | |
| 3,212,593 | 10/1965 | Reischl . | |
| 3,270,823 | 9/1966 | Buehler . | |
| 3,280,920 | 10/1966 | Scott . | |
| 3,286,777 | 11/1966 | Gyongyosi . | |
| 3,386,726 | 6/1968 | Lorenz | 269/31 |
| 3,446,284 | 5/1969 | Dyer et al. . | |
| 3,499,498 | 3/1970 | Bromell et al. . | |
| 3,706,347 | 12/1972 | Brown . | |
| 3,734,208 | 5/1973 | Otto | 414/22 X |
| 3,734,209 | 5/1973 | Haisch et al. . | |
| 3,838,943 | 8/1974 | Simon . | |
| 3,977,480 | 8/1976 | Hilding . | |
| 4,303,270 | 12/1981 | Adair | 414/22 X |
| 4,345,866 | 8/1982 | Greene | 414/741 X |

FOREIGN PATENT DOCUMENTS

| | | | |
|---|---|---|---|
| 54-3759 | 1/1979 | Japan | 294/115 |

*Primary Examiner*—Leslie J. Paperner

*Attorney, Agent, or Firm*—Hume, Clement, Brinks, Willian & Olds, Ltd.

[57] ABSTRACT

A self-centering clamp for drilling tubulars includes first and second transverse guide rods. Two opposed clamping jaws are guided along the first guide rod. These jaws are positioned by two opposed rocker arms, each of which is mounted to a cross brace which slides along the second guide rod. The rocker arms are symmetrically positioned by a link mechanism which also slides along the second guide rod and by a hydraulic cylinder coupled between the two rocker arms. The entire clamp is supported in a frame onto which is mounted the two guide rods. The frame is pivotably mounted to a pipe boom so as to rotate about an axis parallel to the clamped pipe and transverse to the first and second guide rods. In a second embodiment the guide rods are replaced with a plate having guide slots.

35 Claims, 15 Drawing Figures

SELF-CENTERING CLAMP FOR DOWN-HOLE TUBULARS

BACKGROUND OF THE INVENTION

The present invention relates to a device for clamping threaded oil well and water well tubulars and rods, including but not limited to drill pipe, drill collars, well casing, production tubing, sucker rods, pump column pipe, and the like, all of which threaded tubulars and rods are hereinbelow referred to simply as "down-hole tubulars". More particularly, this invention relates to such a clamp which precisely centers down-hole tubulars of varying diameters.

In well drilling and well completion operations it is necessary to lift and precisely align lengths of down-hole tubulars. For example, in oil or water well drilling, multiple lengths of drill pipe must often be raised from a horizontal position at or near ground level to a vertical position aligned with the centerline of the well. Such lifting and aligning operations require a clamp for securely holding the pipe in place as it is lifted. When a pivotably mounted pipe boom is used, this clamp must support large loads in several different orientations.

Compounding the problem is the fact that each joint or length of a down-hole tubular must be closely aligned with a string of such tubulars after it has been lifted to the vertical position, as when a string of drill pipe or casing is being made up, for example. A clamp for this purpose should preferably provide the necessary alignment for down-hole tubulars having various diameters, without any adjustment. Proper alignment has been a problem for many such clamps of the prior art, especially those employing pivoted clamping jaws.

When pivoted clamping jaws are used, there is a tendency for the center of the clamped down-hole tubular to vary as a function of the diameter of the tubular being clamped. This problem may be alleviated somewhat by using guided jaws in conjunction with symmetrically moving pivoted rocker arms. Such an arrangement is shown in a machine tool clamp described by Lorenz in U.S. Pat. No. 3,386,726. In the Lorentz clamp the guided jaws are free to translate with respect to the pivotably mounted rocker arms as the clamp closes.

This approach, however, suffers from the disadvantage that loads are not symmetrically distributed in the clamp for the full range of clamp positions. As the guided jaw translates with respect to the rocker arm, the center of clamping force on the jaw moves.

SUMMARY OF THE INVENTION

The present invention is directed to a self centering clamp for down-hole tubulars which avoids the foregoing described and other disadvantages of the prior art.

The general object of this invention is to provide a clamp for down-hole tubulars which precisely clamps and centers such tubulars in such manner that in each case the tubular is clamped with its central axis at a substantially constant position with respect to the clamp, in spite of variations in the diameter of the clamped tubular.

Another object of this invention is to provide a sturdy clamp which symmetrically bears the clamping forces associated with clamping and holding down-hole tubulars having a range of diameters.

Yet another object of this invention is to provide a clamp having the aforementioned self-centering and symmetrical load bearing features which can clamp down-hole tubulars having a predetermined range of diameters without requiring manual adjustment or replacement of component parts, thereby speeding and facilitating both drilling and well service operations.

Yet another object of this invention is to provide a clamp which can be loaded and unloaded in diverse positions and orientations, thereby facilitating gravity loading and unloading and the use of automated or semiautomated loading and unloading means.

According to this invention, these and other objects are achieved by providing a clamp having two opposed clamping members, each coupled to a respective beam. The two beams are each pivotally supported at a respective pivot point by support means. Means are provided both for guiding the clamping members along a first line and for guiding the support means along a second line. Also included are means for pivoting the first and second beams about their respective pivot points to move the first and second clamping members symmetrically along the first line.

In that the pivot points of the first and second beams and free to move as necessary to follow the clamping members, the clamp of this invention provides substantially symmetrical load bearing capability for a wide range of down-hole tubular diameters. This facilitates the design of a clamp which is sturdy yet not unduly heavy due to the need to withstand assymmetrical clamping loads.

Another advantage of this invention is that down-hole tubulars of varying diameters can be accurately clamped and centered about the same clamping axis. This facilitates precise alignment of the clamp length of down-hole tubulars with other such lengths, such as in a drill string or a production string, for example.

The clamp of this invention provides the further advantage that no manual adjustment or replacement of parts is required to obtain the precise centering and symmetrical clamping described above, even when down-hole tubulars of varying diameters are clamped.

These and other objects and attendant advantages of the present invention will be better understood by reference to the following description taken in connection with the appended drawings.

DETAILED DESCRIPTION OF PREFERRED EMBODIMENTS

Figure 1:
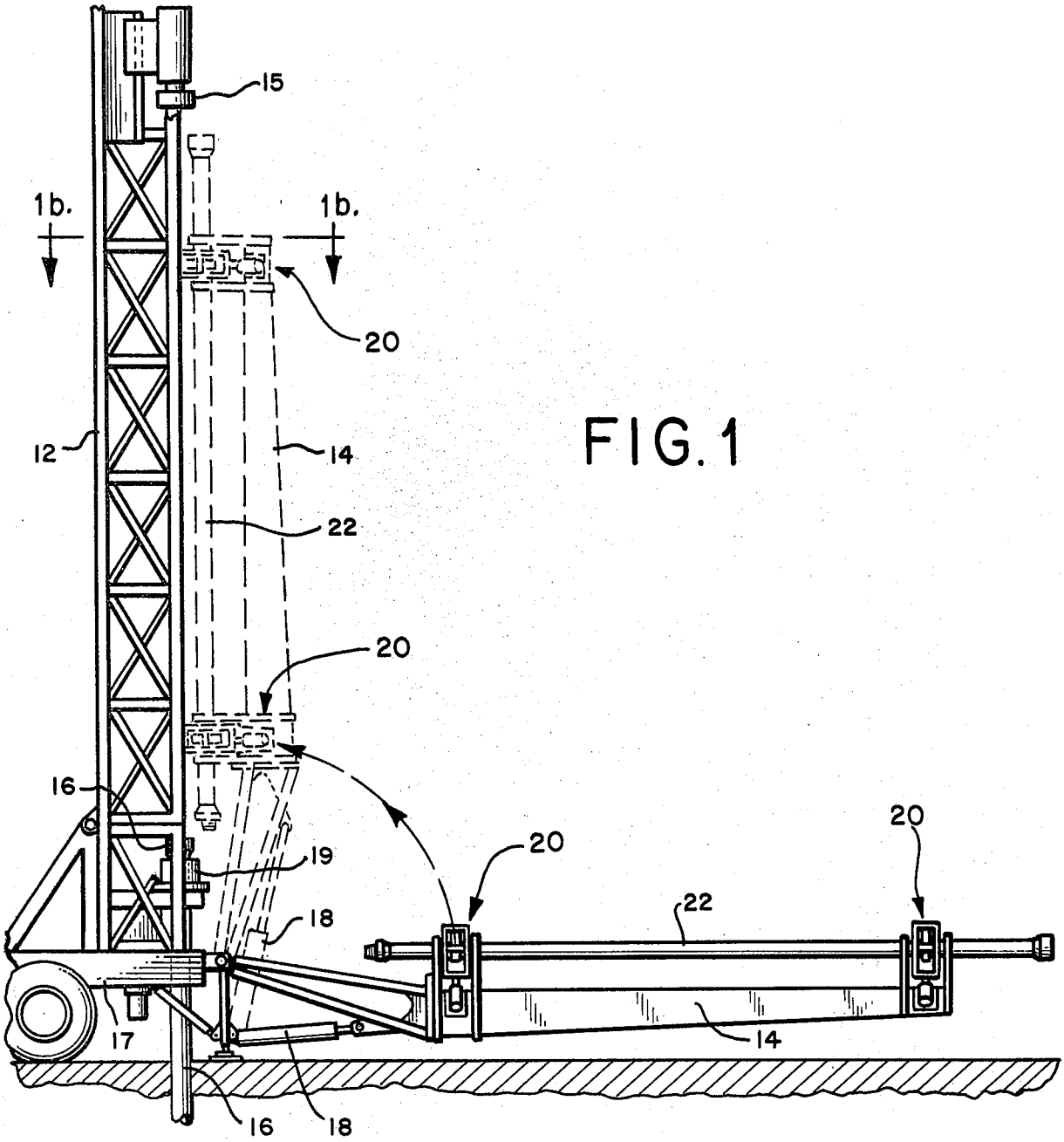
FIG. 1 is an elevational view of a drilling rig including a pivoted pipe boom and a first preferred embodiment of the clamp of this invention.

Referring now to the drawings, FIG. 1 shows a first preferred embodiment of the clamp of this invention installed on a drilling rig. The drilling rig, designated generally by the reference numeral 10, includes a tower 12 and a pipe boom 14. The tower 12 extends above the centerline of the pipe string 16, and includes such conventional components as a drilling platform 17, slips 19, and heavy lifting and pipe rotating equipment 15. The pipe boom 14 is pivotably mounted to the base of the tower 12 and is provided with a hydraulic cylinder 18 which operates to pivot the boom between the horizontal position, shown in solid lines, and a vertical position, shown in dotted lines, in which the boom 14 is substantially parallel to the tower 12. The boom 14 is provided with two clamps 20 spaced along its length. The clamps 20, which will be described in detail below, operate to securely hold a length of drill pipe 22 as it is either raised or lowered between the horizontal position and a vertical position, coaxial with the drill string 16.

Except for the clamp 20 and its mounting arrangement, the drilling rig is a conventional structure, known to those skilled in the art. It forms no part of the present invention and has only been described by way of background to permit a better understanding of the operation of the clamp of this invention. Accordingly, this drilling rig will not be described in detail here.

Figure 1B:
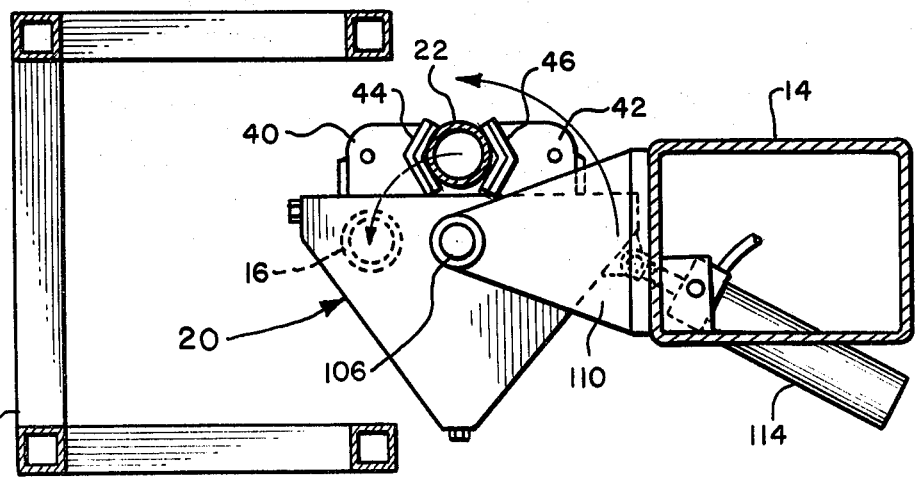
FIG. 1*b* is a sectional view along line 1*b*—1*b* of FIG. 1, showing the pipe boom in the vertical position, before the clamps have been rotated to align the clamped drill pipe with the centerline of the well.
Figure 1A:
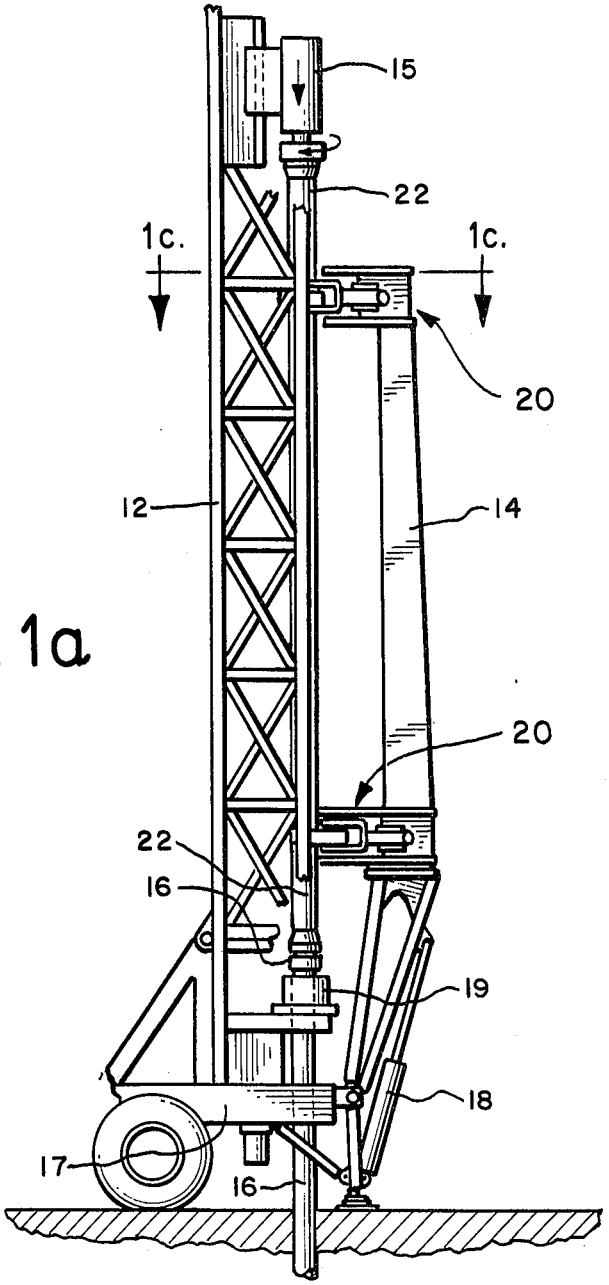
FIG. 1*a* shows the pipe boom of FIG. 1 raised to the vertical position with the clamps rotated to align the clamped down-hole tubular, a joint of drill pipe, with the centerline of the well.

The clamps 20 are each pivotably mounted to the boom 14 such that they can be rotated about an axis parallel to the clamped drill pipe 22. This mounting arrangement will be described in detail below. Following that description, the operation of the boom and clamp will be described in connection with FIGS. 1*a*–1*c*.

Figure 2:
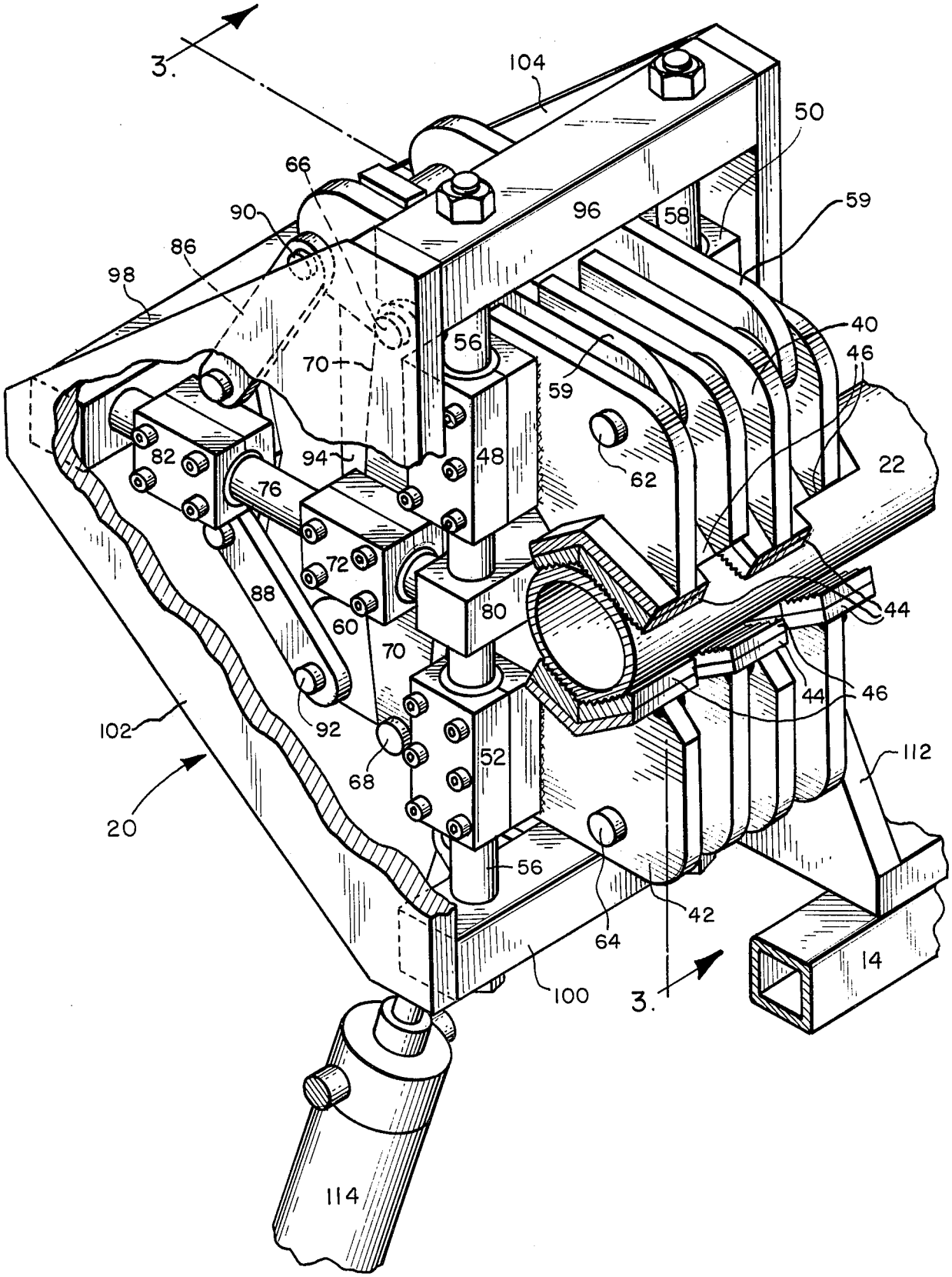
FIG. 2 is a partial perspective view of the clamp of FIG. 1.
Figure 3:
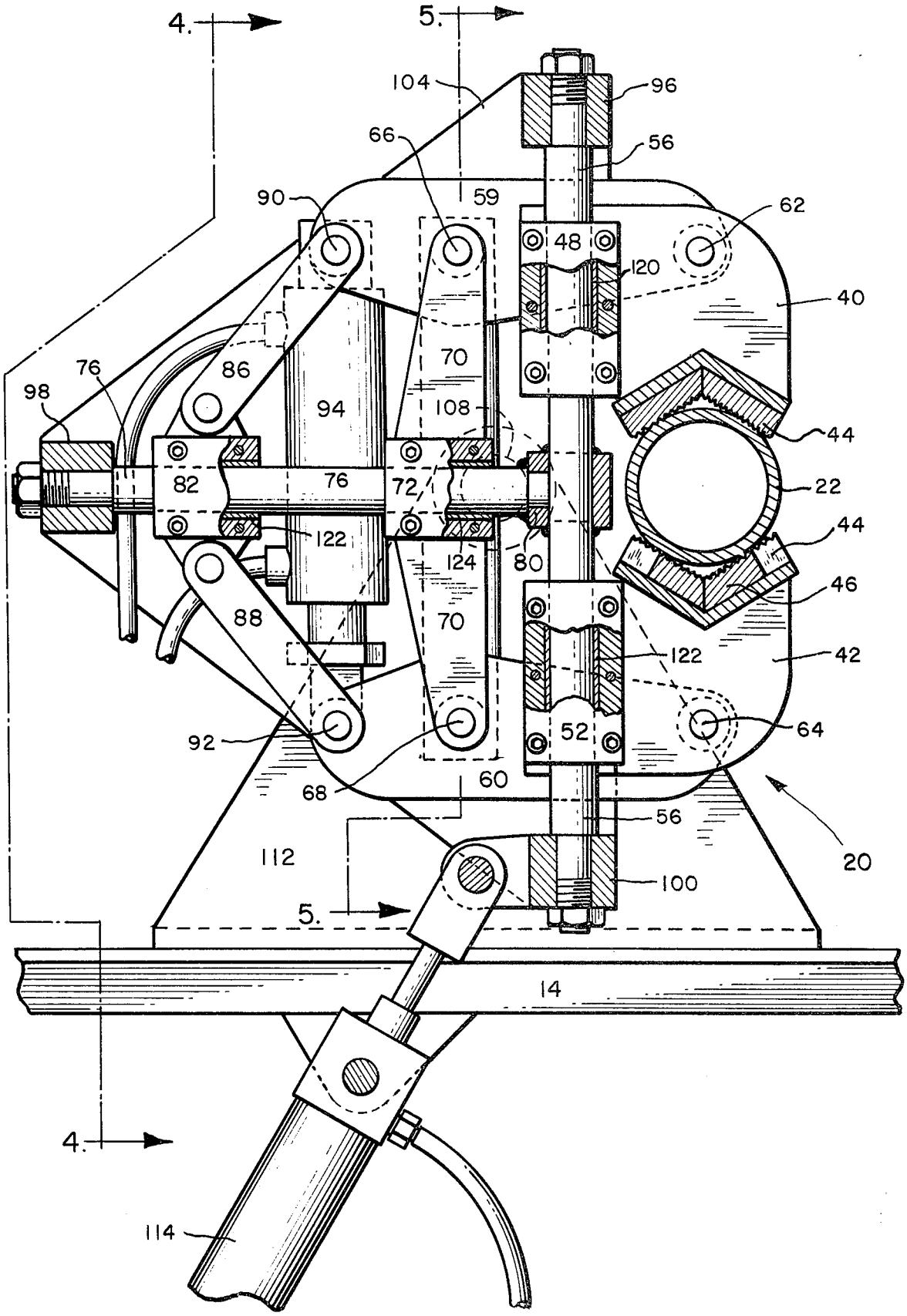
FIG. 3 is a sectional view taken along line 3—3 of FIG. 2.
Figure 4:
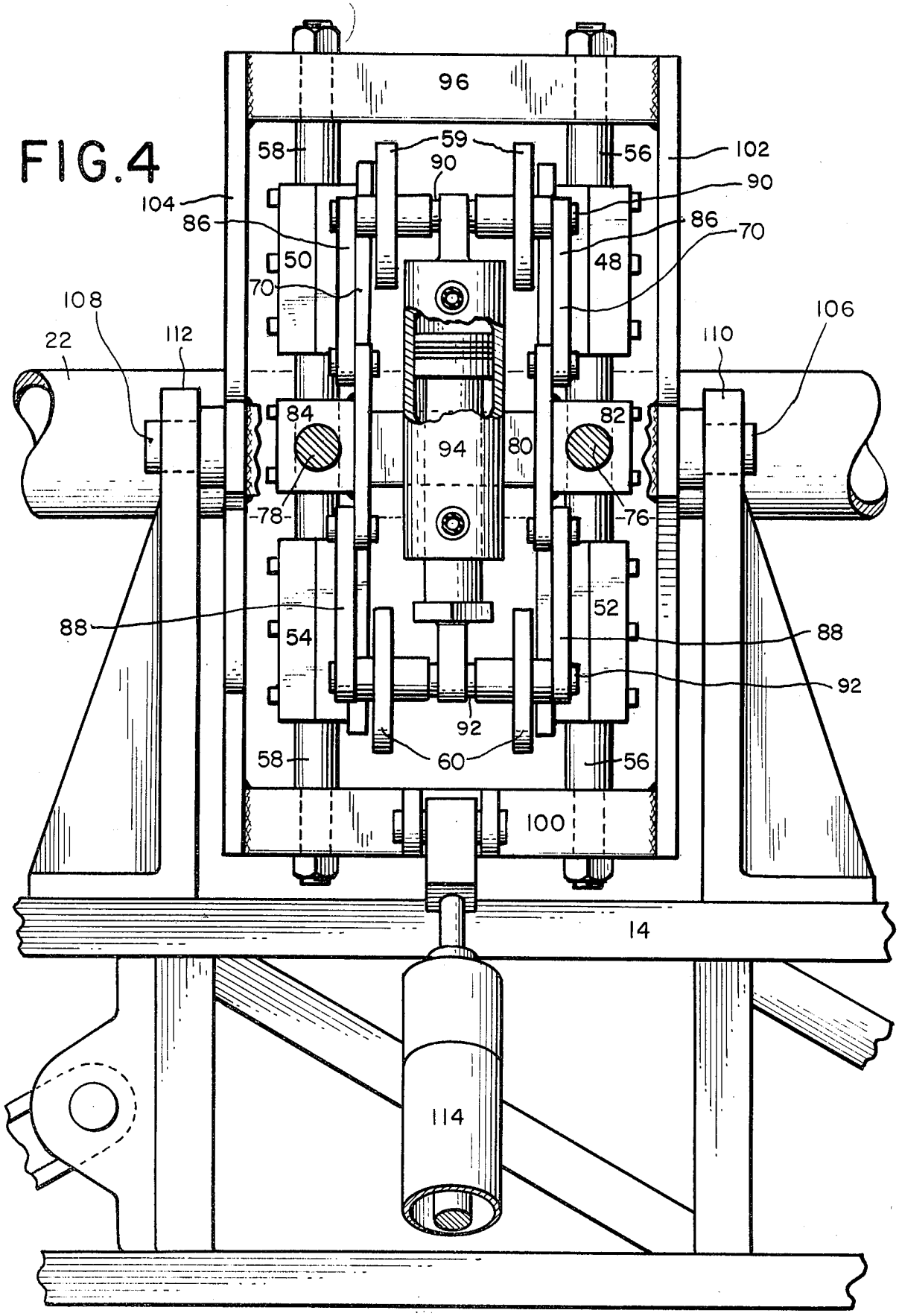
FIG. 4 is a sectional view taken along line 4—4 of FIG. 3.
Figure 5:
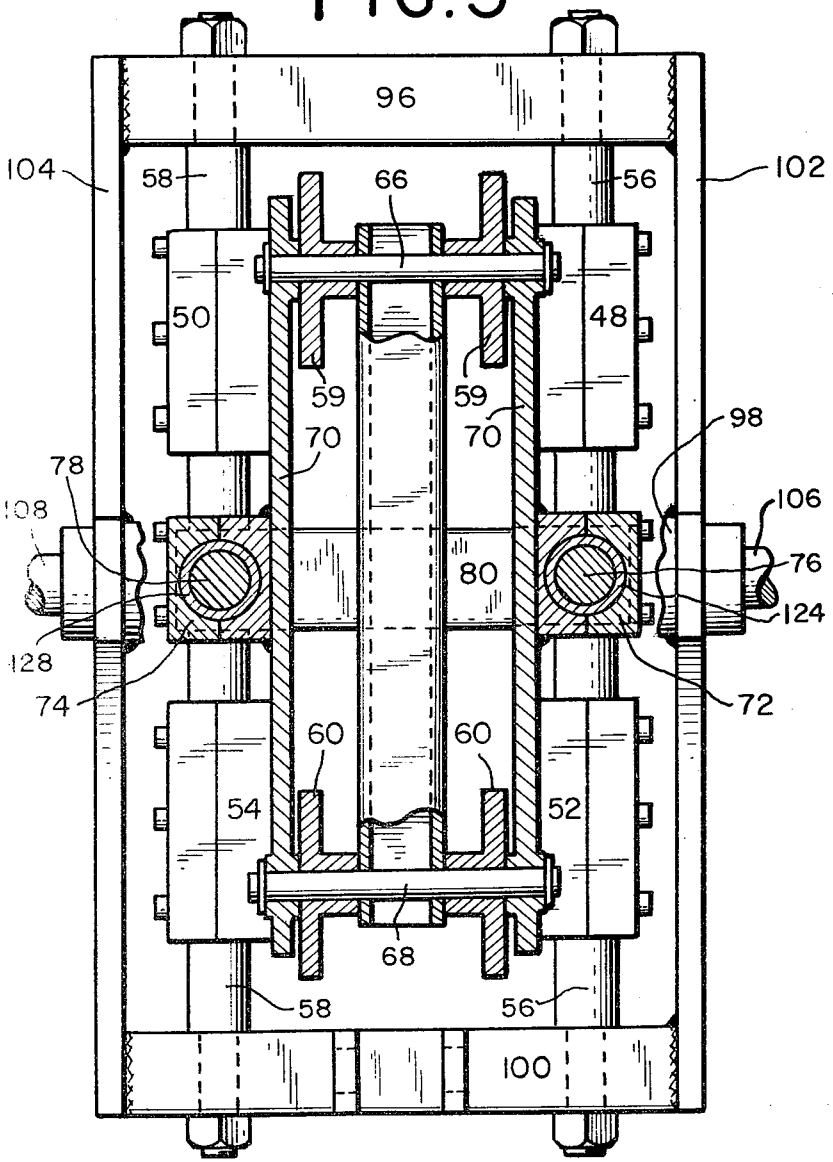
FIG. 5 is a sectional view taken along line 5—5 of FIG. 3.

FIG. 2 shows a perspective view of one of the clamps of FIG. 1, showing the drill pipe 22 clamped in place. FIGS. 3–5 show various cross-sectional views of the clamp 20. The following description will make reference to FIGS. 2–5 in describing the structure of the clamp 20.

The drill pipe 22 is held in place by two opposed clamping jaws 40,42, each of which includes a plurality of clamping surfaces for contacting and gripping the drill pipe 22. As shown, the clamping surfaces on each jaw 40,42 include two elongated clamping members 44 and two shortened clamping members 46, so arranged that when the jaws are brought together, the elongated clamping members 46 of one jaw oppose the shortened clamping members 42 of the other jaw. This arrangement allows the clamping surfaces of the opposed jaws 40,42 to interleave when small pipes are clamped, and, therefore, permits the clamp 20 to be used with small diameter pipe. Preferably, the clamping members 44,46 are made of a hard metal and are provided with a roughened surface for frictionally engaging the clamped drill pipe 22.

Each of the two jaws 40,42, is rigidly mounted to two guide sleeves 48,50 and 52,54, respectively, which are arranged to slide along two guide bars 56,58. These two guide bars 56,58, which are parallel to one another and disposed on either side of the jaws 40,42, cooperate with the guide sleeves 48,50,52,54 to control the movement of the jaws 40,42. The jaws 40,42 are limited to translatory motion parallel to the guide rods 56,58 and are substantially prevented from rotating or pivoting.

Each jaw 40,42 is pivotably connected to one of a pair of opposed rocker arms 59,60 at a pivot axis 62,64, respectively. The two pivot axes 62,64 permit pivoting movement between the respective jaw 40,42 and rocker arms 59,60 about an axis perpendicular to the guide rods 56,58. Each rocker arm 59,60 is provided with a pivot axis 66,68 parallel to the pivot axes 62,64, at which the rocker arm is pivotably connected to a cross brace 70. The cross brace 70 extends between the opposed rocker arms 59,60 and provides a movable point of rotation for the rocker arms 59,60. A guide sleeve 72,74 is rigidly mounted to each cross brace 70 and is mounted to slide along a guide rod 76,78, respectively. The guide rods 76,78 are parallel to one another and are perpendicular and transverse to the guide rods 56,58, respectively. The four guide rods 56,58,76,78 are rigidly interconnected by a brace member 80. This brace member 80 maintains guide rods 76 and 56 in a first plane and guide rods 78,58 in a second plane, parallel to the first.

Guide sleeves 82,84 are also slideably mounted on the guide bars 76,78, respectively. Each of these guide sleeves 82,84 has two link members 86,88 pivotably mounted to opposite sides of the guide sleeve. These link members 86,88 are in turn pivotably connected to the respective rocker arms 59,60 at pivot axes 90,92, parallel to the pivot axes 66 and 68, respectively. Also connected between the rocker arms 59,60 at the axes 90,92 is a hydraulic cylinder 94. This cylinder 94 operates to determine the separation between the rocker arms 59,60 at the pivot axes 90,92, and thereby to control the clamping action of the jaws 40,42.

The four guide rods 56,58,76,78 are held in place by a rigid framework made up of three parallel beams 96,98,100 and two parallel opposed plates 102,104. Each of the two plates 102,104 is of a generally triangular shape, and one of the three beams 96,98,100 is mounted between the two plates 102,104 at each apex. The three beams 96,98,100 serve as anchor points for the guide rods 56,58,76,78; specifically, guide rods 76,78 are secured to beam 98 and guide rods 56,58 are secured to beam 96 at one end and to beam 100 at the other end. Together, the plates 102,104 and the beams 96,98,100 make up a rigid space frame which supports the clamp 20.

In this preferred embodiment, each of the guide rods 56,58,76,78 is a cylindrical steel rod, similar to the rod used in the manufacture of hydraulic cylinder assemblies. Each of the guide sleeves 48,50,52,54,72,74,82,84 includes a guide bushing (see, e.g., elements 120,122,124,126,128 of FIGS. 3–5) made of brass, bronze, a synthetic material, or some other suitable bushing material. Seals similar to those used in hydraulic cylinder assemblies may be used to prevent dirt and other abrasive material from contaminating the guide sleeves 48,50,52,54,72,74,82,84.

As best shown in FIGS. 3 and 4, each of the plates 102,104 is provided with a shaft 106,108 which is rotatably supported by a support plate 110,112, which in turn is rigidly secured to the pipe boom 14. In this manner, the entire clamp 20 is pivotably mounted onto the boom 14 to rotate about an axis parallel to the clamped drill pipe 22. A hydraulic cylinder 114 is pivotably mounted between the beam 100 and the boom 14 to rotationally position the clamp 20 in the desired position.

The operation of the clamp 20 will now be explained with particular reference to FIGS. 3 and 6, which show the clamp 20 in use with large and small diameter drill pipe, respectively. As explained above, the plates 102,104, the beams 96,98,100, the guide rods 56,58,76,78, and the brace 80 form a rigid structure, the component parts of which are rigidly interconnected. The remainder of the clamp 20 is slidingly supported on the guide rods 56,58,76,78. Specifically, the jaws 40, 42 are guided on the guide rods 56,58 such that their centerline remains parallel to and at a fixed distance from the guide rods 56,58.

As the rocker arms 59,60 pivot about the cross brace 70, the cross brace 70 and the rocker arms 59,60 slide along the guide rods 76,78 as necessary to maintain the proper spacing with respect to the jaws 40,42. The link members 86,88 and the associated guide sleeves 82,84 also slide along the guide rods 76,78 as necessary to follow the movement of the rocker arms 59,60. The link members 86,88 position the rocker arms 59,60 symmetrically and ensure that the jaws 40,42 are disposed symmetrically with respect to the guide rods 76,78.

Figure 6:
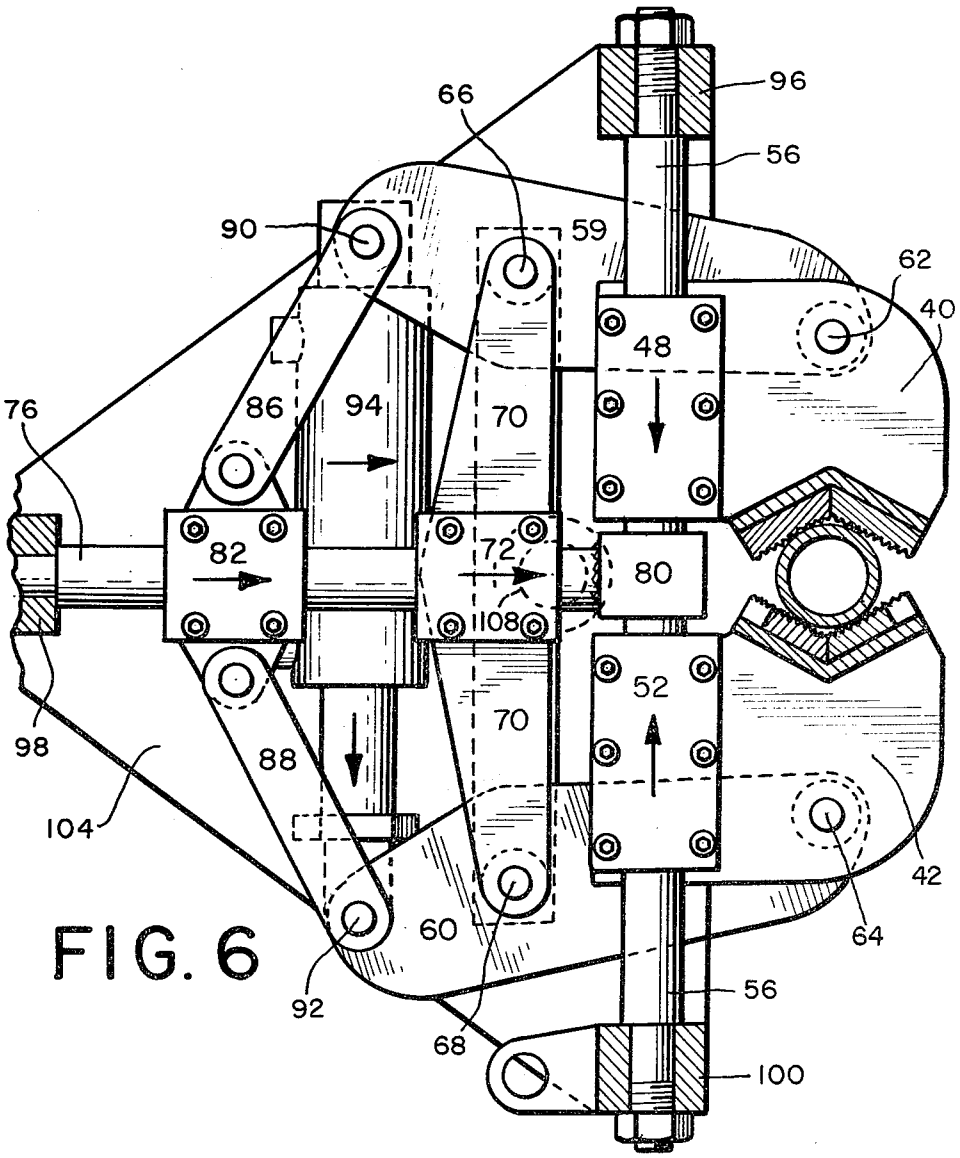
FIG. 6 is a sectional view similar to FIG. 3 showing the clamp gripping a small diameter drill pipe.

When the jaws 40,42 are moved from the position shown in FIG. 3 to that shown in FIG. 6, considerable movement takes place between the various elements of the clamp and the guide rods. Specifically, the jaws 40,42 move together, guided by the guide rods 56,58. Also, the cross brace 70 moves toward the jaws 40,42 guided by the guide rods 76,78. The hydraulic cylinder 94 as well as the link members 86,88 and the associated guide sleeves 82,84 also move toward the jaws 40,42. This movement allows the clamp 20 to clamp both the large diameter drill pipe of FIG. 3 and the small diameter drill pipe of FIG. 6 about the same clamping axis. Furthermore, no adjustment is required to adapt the clamp for varying diameters of drill pipe or other down-hole tubulars, and the clamping loads are borne symmetrically for both large diameter and small diameter pipe.

Figure 1C:
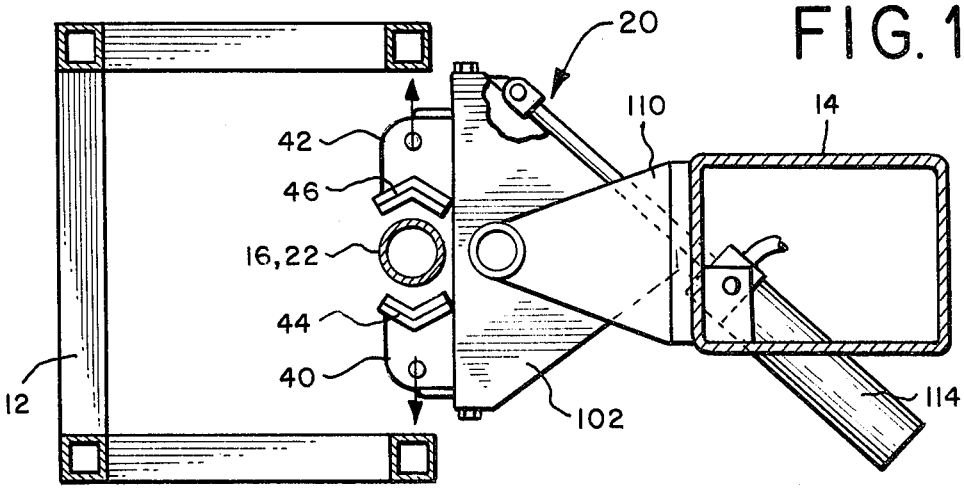
FIG. 1*c* is a sectional view taken along 1*c*—1*c* of FIG. 1*a*.

Referring to FIGS. 3 and 1–1*c*, the clamp 20 is rotatably mounted to the boom 14 to facilitate loading and unloading down-hole tubulars with the pipe boom 14 in the horizontal position (FIG. 1). FIG. 3 shows the clamp 20 rotated into a first position for moving a drill pipe into and out of the clamp 20. In this position guide rods 76,78 are substantially horizontal and guide rods 56,58 are substantially vertical. Side loading of the drill pipe into the clamp is, therefore, possible. See FIG. 1 for a general depiction of the clamps 20 and boom 14 as positioned for loading or removing drill pipe from the clamps 20. After the drill pipe has been loaded and the boom 14 has been raised into the upright position (FIGS. 1*a* and 1*b*), the clamp 20 can then be rotated by means of the cylinder 114 to place the drill pipe 22 into the position shown in FIG. 1*c*, coaxial with the centerline of the well. Because the clamp 20 holds various diameters of down-hole tubulars accurately, each centered about the same clamping axis, the rotated clamp accurately positions the drill pipe, ready to be threaded onto the drill pipe string in the well. The jaws 40,42 can then be opened (FIG. 1*c*) to release the drill pipe 22 from the clamp 20 and to allow the boom 14 to be lowered.

Referring now to FIGS. 7–12, a second preferred embodiment of the clamp of this invention utilizes a slotted guide plate instead of the guide bars of the clamp described above. The following detailed description of this second preferred embodiment, indicated generally by the reference numeral 200, is made with reference to FIGS. 7–10.

Figure 7:
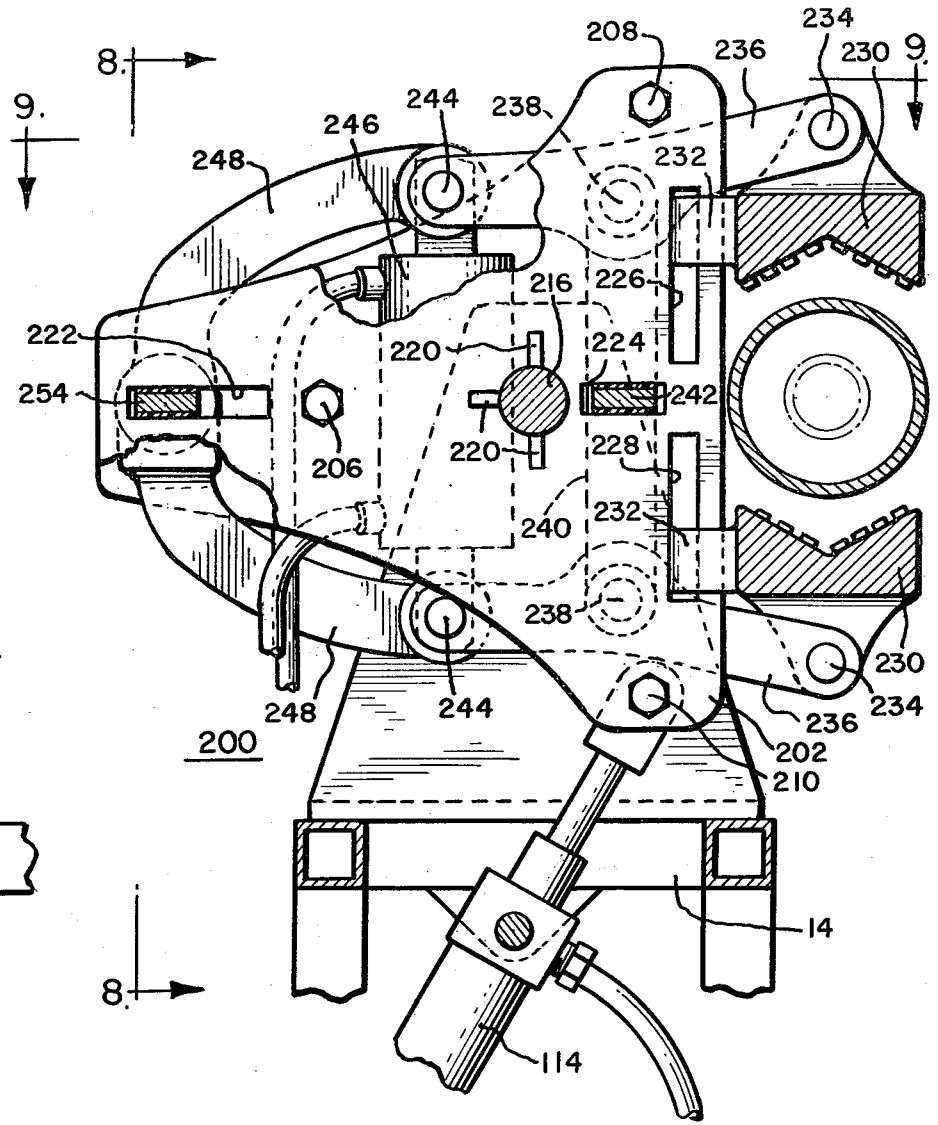
FIG. 7 is a side view of a second preferred embodiment of the clamp of this invention.
Figure 8:
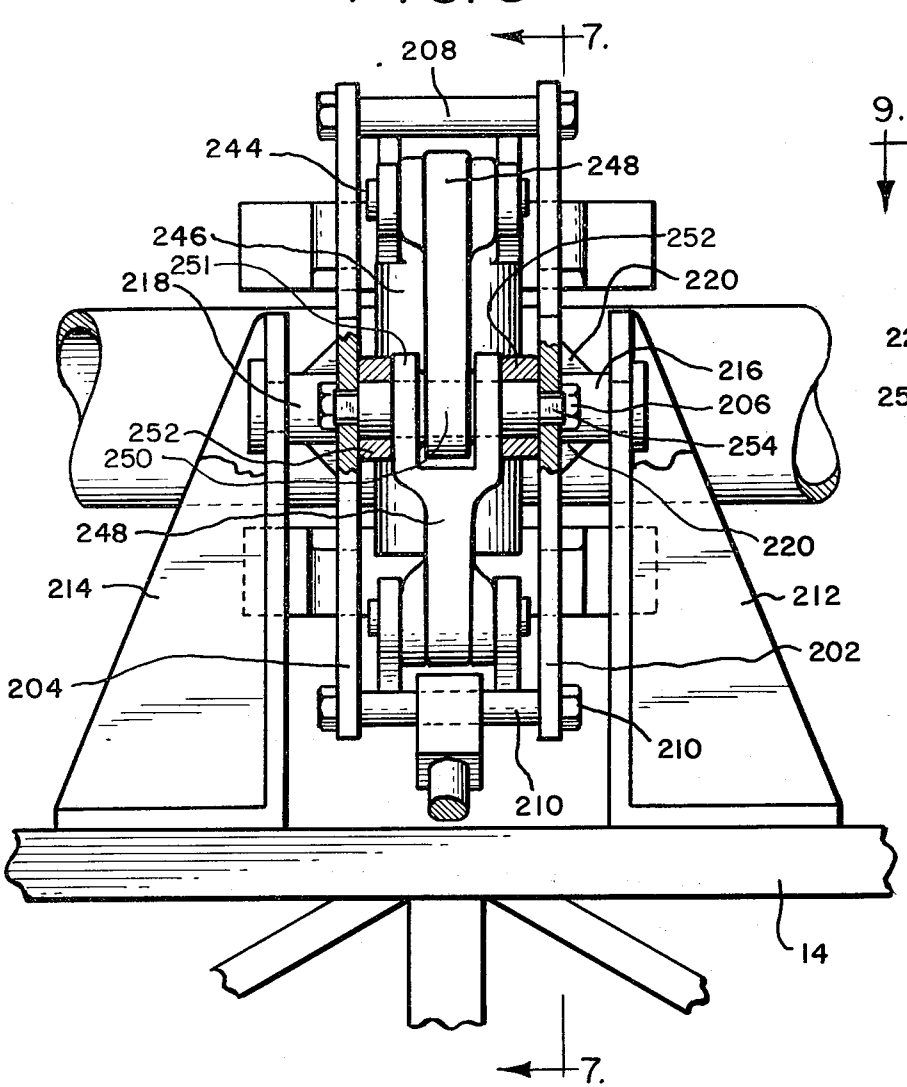
FIG. 8 is an end view taken along line 8—8 of FIG. 7.
Figure 9:
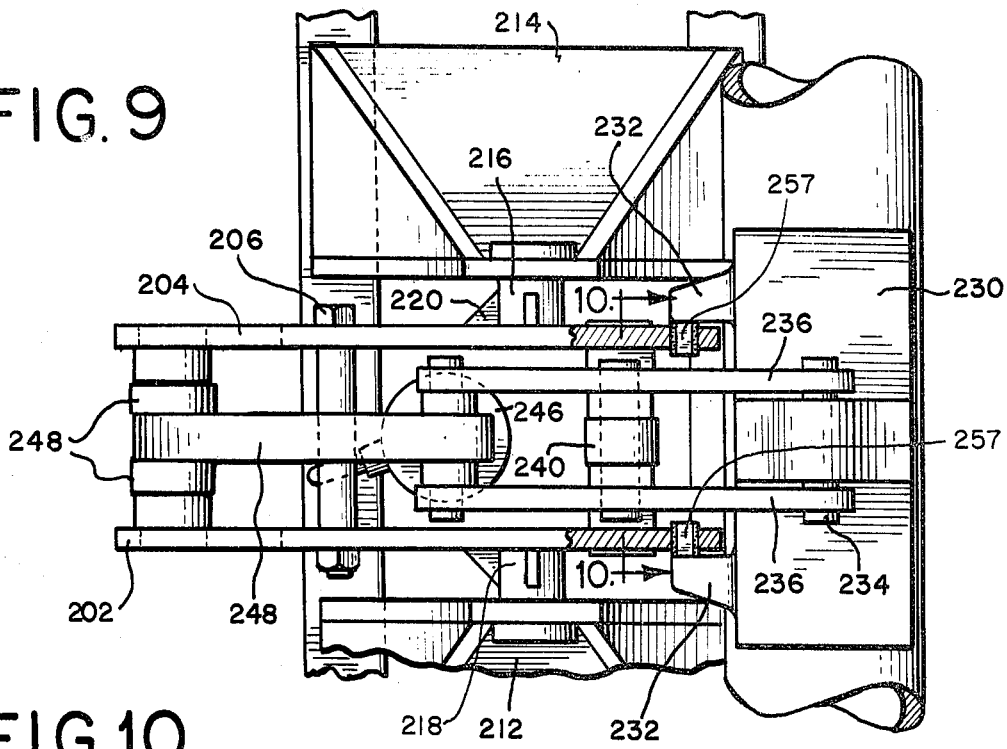
FIG. 9 is a top view taken along line 9—9 of FIG. 7.

As best shown in FIGS. 7 and 8, the second preferred embodiment includes two spaced guide plates 202,204 which are rigidly secured at a predetermined separation by three spacers 206,208,210. The combination of the guide plates 202,204 and the spacers 206,208,210 creates a rigid space frame which supports the remaining elements of the clamp. The guide plates 202,204 are rotatably mounted to the pipe boom 14 via shafts 216,218 which engage support structures 212,214. A hydraulic cylinder 114 is mounted between the pipe boom 14 and the spacer 210 such that the cylinder 114 operates to rotate the clamp 200 with respect to the boom 14. The mounting and movement of the clamp 200 is essentially identical to the mounting and movement of the first preferred embodiment described above. The shafts 216,218 are braced by gussets 220 to mount them firmly to the guide plates 202,204.

Each of the guide plates 202,204 defines four spaced guide slots 222,224,226,228. As best shown in FIG. 7, guide slots 222 and 224 are colinear and pass through the centerline of the clamped down-hole tubular. Guide slots 226,228 are also colinear and are arranged perpendicular to the line defined by guide slots 222,224. As will be seen from the following discussion, the guide slots 222,224 perform much the same function as the guide bar 76,78 of the first preferred embodiment, and the guide slots 226,228 perform much the same function as the guide bars 56,58 of the first preferred embodiment.

Figure 10:
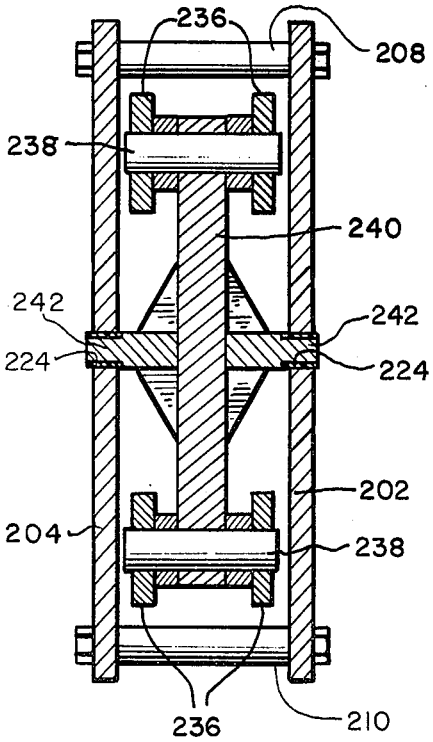
FIG. 10 is a sectional view taken along line 10—10 of FIG. 9.

The clamp 200 includes two opposed clamping jaws 230, each of which is provided with two guides 232. The two guides 232 of the lower jaw 230 fit within and slide along the opposed guide slots 228, while the two guides 232 of the upper jaw 230 fit within and slide along the opposed guide slots 226. The guides 232 and the guide slots 226,228 cooperate to insure that the clamping jaws 230 move only in a rectilinear line which is fixed with respect to the guide plates 202,204. Each of the jaws 230 includes a pivot 234 which is coupled to a rocket arm 236. Each rocker arm is provided with a central pivot 238 which pivotably connects the rocker arm 236 with a cross bar 240. The cross bar 240 is provided with a guide 242 which engages the opposed guide slots 224. As best shown in FIGS. 7 and 10, the guide 242 permits limited translational motion of the cross bar 240 along a line which passes through the center of the clamped down-hole tubular.

In addition, each rocker arm 236 includes a second pivot 244 opposed to the first pivot 234. This second pivot 244 serves as an attachment point for a hydraulic cylinder 246. The hydraulic cylinder 246 serves to position the clamping jaws 230. As the cylinder 246 expands, the rocker arms 236 are pivoted and the clamping jaws 230 are made to approach one another. Conversely, as the hydraulic cylinder 246 contracts, the rocker arms 236 are pivoted to move the jaws 230 away from one another.

The pivots 244 also serve to connect link members 248 to the rocker arms 236, respectively. These link members 248 are in turn coupled to a guide 254. The upper link member 248 terminates in a pivot 250 which pivots about the guide 254, and the lower link member 248 terminates in a clevis 251 which also pivots about the guide 254. Two spacers 252 serve to center the link members 248 between the guide plates 202,204. The guide 254 is arranged to slide along the opposed guide slots 222. The link members 248 serve to maintain the clamping jaws 230 in symmetrical positions with respect to the line passing through the colinear guide slots 222,224. In so doing, the guide 254 moves along the guide slot 222.

Figure 11:
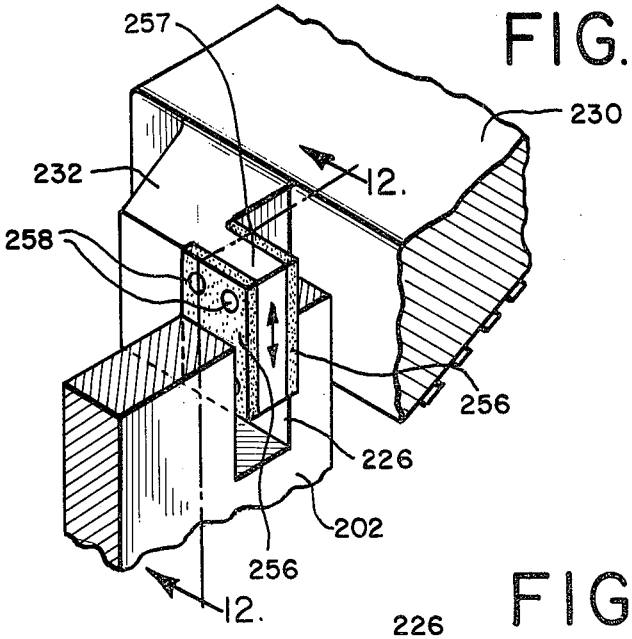
FIG. 11 is a detailed partial perspective view of the clamp of FIGS. 7–10.
Figure 12:
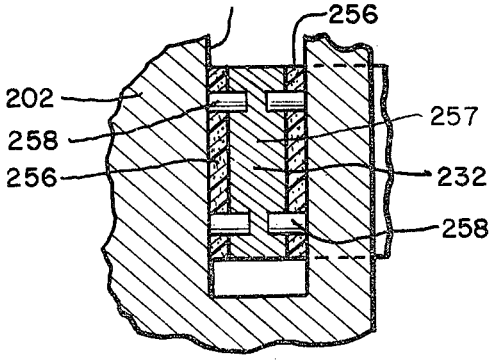
FIG. 12 is a partial sectional view taken along line 12—12 of FIG. 11.

Referring now to FIGS. 11 and 12, the guides 232 each include a lug 257 on which is mounted a planar bearing surface 256 positioned to contact the edge of the guide slot 226,228. As shown in FIG. 12, each of these bearing surfaces 256 is held in place by a number of pins 258 which prevent the guide surface 256 from sliding with respect to the lug 257. Preferably, both the pins 258 and the bearing surfaces 256 are formed of a bearing material such as Nylatron. In this preferred embodiment, the bearing surface 256 is three-sixteenths of an inch in thickness. Because the pins 258 are formed of the same material as the bearing surfaces 256, the pins wear at the same rate as the bearing surfaces. This prevents the pins from gouging or scoring the sides of the guide slots. In this preferred embodiment, each of the pins is seven-sixteenths of an inch in diameter and about one-half of an inch in length.

The detailed structure discussed above in connection with FIGS. 11 and 12 is representative of the guides 254 and 242 as well. In each case the guide includes a rectangular lug measuring one inch by four inches in this preferred embodiment. As described above, each lug is jacketed on two opposed sides with Nylatron bearing surfaces. Nylatron provides excellent wear characteristics and can readily be replaced when necessary by simply disassembling the clamp, removing the bearing surfaces 256, and replacing both the bearing surfaces 256 and the pins 258.

The clamp 200 of this preferred embodiment is formed from steel plate. The guide plates 202,204 of this embodiment are five-eighths of an inch in thickness, as are the rocker arms 236, the link members 248. In this preferred embodiment, the cross bar 240 is formed from one inch think steel plate, and is gusseted to the guide 242 as shown in FIG. 10.

The clamp of this invention provides the important advantage that a down-hole tubular can be loaded into the clamp with the boom in the horizontal position from the side. Side loading brings with it the advantages of gravity loading. The clamp can easily be mounted to the boom to permit loading and offloading to either side of the boom. The axis of clamp rotation defined by the shafts 106,108 should be chosen to provide the desired geometry. Specifically, the separation between the axis of rotation and the centerline of the clamped drill pipe 22 can be placed in other positions than that shown, and should be coordinated with the positioning of the clamp 20 on the boom 14 such that the clamped drill pipe will be moved to the centerline of the well when the boom 14 is raised and the clamp 20 is rotated. Secondly, the axis of rotation should be chosen to provide the desired clamp height for loading and unloading operations when the boom is in the horizontal position and the clamp is rotated into the position shown in FIG. 3. The presently preferred embodiment of the clamp 20,200 is sized to clamp and accurately position down-hole tubulars having diameters in the range of $2\frac{7}{8}$ inches to $8\frac{5}{8}$ inches without adjustment. This clamp is proportioned to firmly clamp drill collars weighing as much as 4,500 pounds as they are accelerated and rotated by the pipe boom.

From the foregoing it should be apparent that the clamp of this invention is well suited for accurately clamping down-hole tubulars having a wide range of diameters. In each case, the clamped down-hole tubular is accurately positioned without clamp adjustment, and clamping loads are symmetrically borne by the clamp. The clamp is sturdy and capable of bearing the weight of a heavy drilling collar in the various orientations encountered in raising and lowering the boom.

Of course, it should be understood that various changes and modifications to the preferred embodiments described herein will be apparent to those skilled in the art. For example, the size of the clamp may be varied to fit the intended application, and the clamp may be mounted nonrotatably onto the pipe boom if desired. Alternately, other rotating means, such as a rack and pinion arrangement, can be used to rotatably position the clamp on the boom. Such changes and modifications can be made without departing from the spirit and scope of the present invention, and without diminishing its attendant advantages. It is, therefore, intended that such changes and modifications be covered by the following claims.

I claim:

1. A self-centering clamp for clamping down-hole tubulars of various diameters, said clamp comprising:

first and second opposed clamping members;

means for guiding the first and second clamping members along a first line;

first and second opposed beams coupled to the first and second clamping members, respectively, each of said first and second beams having a pivot point;

means for pivotably supporting the first and second beams at the respective pivot points such that a constant separation is maintained between the pivot points;

means for guiding the support means along a second line; and means for pivoting the first and second beams about the respective pivot points to move the first and second clamping members symmetrically along the first line.

2. The clamp of claim 1 wherein the means for guiding the first and second clamping members comprises:

a first guide rod; and first and second guide sleeves rigidly mounted to the first and second clamping members, respectively, to slide along the first guide rod.

3. The clamp of claim 1 or 2 wherein the means for pivotably supporting the first and second beams comprises a cross brace pivotably coupled to the first and second beams at the respective pivot points.

4. The clamp of claim 3 wherein the means for guiding the support means comprises:

a second guide rod; and a third guide sleeve mounted on the cross brace to slide on the second guide rod.

5. The clamp of claim 4 wherein the means for pivoting comprises:

first and second link members pivotably connected to the first and second beams, respectively; and a fourth guide sleeve coupled to the first and second link members to slide along the second guide rod.

6. The clamp of claim 1 or 2 wherein the means for guiding the support means comprises:

a second guide rod; and a third guide sleeve mounted on the support means to slide on the second guide rod.

7. The clamp of claim 6 wherein the pivoting means comprises:

first and second link members pivotally connected to the first and second beams, respectively; and a fourth guide sleeve coupled to the first and second link members to slide along the second guide rod.

8. The clamp of claim 1 or 2 wherein the pivoting means comprises a hydraulic cylinder coupled between the first and second beams and oriented parallel to the first line.

9. The clamp of claim 1 wherein the means for guiding the first and second clamping members comprises:

means for defining first and second guide slots; and first and second guides mounted to the first and second clamping members, respectively, to slide along and within the first and second guide slots, respectively.

10. The clamp of claim 9 wherein the means for pivotably supporting the first and second beams comprises a cross bar pivotably coupled to the first and second beams at the respective pivot points.

11. The clamp of claim 10 wherein the means for guiding the support means comprises:

means for defining a third guide slot; and a third guide mounted on the cross bar to slide along and within the third guide slot.

12. The clamp of claim 9 wherein the means for guiding the support means comprises:

means for defining a third guide slot; and a third guide mounted to the support means to slide along and within the third guide slot.

13. The clamp of claim 9 or 12 wherein the pivoting means comprises a hydraulic cylinder coupled between the first and second beams.

14. The clamp of claim 9 or 12 wherein the pivoting means comprises:

first and second link members pivotably connected to the first and second beams, respectively;

means for defining a fourth guide slot; and a fourth guide mounted to the first and second link members to slide along and within the fourth guide slot.

15. The invention of claim 1 wherein the pivoting means contacts the beams at points spaced from the respective pivot points.

16. A self-centering clamp for clamping down-hole tubulars, said clamp comprising:

first and second clamping jaws;

a rigid cross brace;

first and second rocker arms, pivotably connected to the first and second jaws, respectively, to pivot about respective pivot axes, each rocker arm pivotably connected to the cross brace such that the separation between the pivot axes is held constant;

means for guiding the first and second jaws along a first line;

means for guiding the cross brace along a second line, substantially transverse to the first line; and means for positioning the first and second rocker arms to move the jaws symmetrically along the first line.

17. The clamp of claim 16 wherein the positioning means comprises a hydraulic cylinder coupled between the first and second rocker arms.

18. The clamp of claim 16 wherein the means for guiding the first and second jaws comprises:

a first guide rod; and first and second guide sleeves rigidly mounted on the first and second jaws, respectively, to slide on the first guide rod.

19. The clamp of claim 16 or 18 wherein the means for guiding the cross brace comprises:

a second guide rod; and a third guide sleeve mounted on the cross brace to slide on the second guide rod.

20. The clamp of claim 19 wherein the positioning means comprises:

first and second link members pivotably connected to the first and second rocker arms, respectively; and a fourth guide sleeve pivotably mounted to the first and second link members to slide along the second guide rod.

21. The clamp of claim 16 wherein the means for guiding the first and second jaws comprises a first guide rod, the means for guiding the cross brace comprises a second guide rod, and the clamp further comprises a frame for rigidly securing the first and second guide rods in place.

22. The clamp of claim 2 further comprising means for pivotably mounting the frame to a support surface about an axis perpendicular to both the first and second guide rods.

23. The clamp of claim 16 wherein the means for guiding the first and second jaws comprises:

means for defining first and second guide slots; and first and second guides rigidly mounted on the first and second jaws, respectively, to slide along and within the first and second guide slots, respectively.

24. The clamp of claim 23 wherein the means for guiding the cross brace comprises:

means for defining a third guide slot; and a third guide mounted on the cross brace to slide along and within the third guide slot.

25. The clamp of claim 24 wherein the positioning means comprises:

first and second link members pivotably connected to the first and second rocker arms, respectively;

means for defining a fourth guide slot; and a fourth guide mounted to the first and second link members to slide along and within the fourth guide slot.

26. The clamp of claim 16 wherein the clamp further comprises a guide plate, the means for guiding the first and second jaws comprises first and second guide slots defined by the guide plate, and the means for guiding the cross brace comprises a third guide slot defined by the guide plate.

27. The clamp of claim 26 wherein the clamp further comprises means for pivotably mounting the guide plate about an axis perpendicular to the guide plate.

28. The invention of claim 16 wherein the pivoting means contacts the rocker arms at points spaced from the respective pivot axes.

29. A self-centering clamp for clamping a down-hole tubular, said clamp mountable on a pipe boom of a pipe handling apparatus and comprising:

first and second substantially transverse guide rods;

first and second opposed clamping jaws;

means for guiding the first and second jaws along the first guide rod;

first and second rocker arms pivotably connected to the first and second jaws, respectively;

a cross brace having a first end pivotably connected to the first rocker arm at a first pivot point and a second end pivotably connected to the second rocker arm at a second pivot point, such that a constant separation is maintained between the pivot points;

means for guiding the cross brace along the second guide rod;

means for positioning the first and second rocker arms to move the jaws symmetrically along the first guide rod;

a rigid frame for securely and rigidly mounting the first and second guide rods in place; and means for rotatably securing the frame to a pipe boom such that the frame is rotatable about an axis substantially transverse to both the first and second guide rods.

30. A self-centering clamp for clamping down-hole tubulars, said clamp mountable on a pipe boom of a pipe handling apparatus and comprising:

first and second guide plates, each guide plate defining first and second colinear guide slots and third and fourth colinear guide slots arranged along a line transverse to the line passing through the first and second guide slots;

means for maintaining the first and second guide plates in a spaced, parallel relationship such that the first, second, third, and fourth guide slots of the first guide plate oppose the first, second, third and fourth guide slots of the second guide plate;

a first clamping jaw having a pair of first opposed guides, each of said first opposed guides positioned to slide within a respective one of the first guide slots;

a second clamping jaw having a pair of second opposed guides, each of said second opposed guides positioned to slide within a respective one of the second guide slots;

first and second rocker arms pivotably connected to the first and second clamping jaws, respectively;

a cross bar having a first end pivotably connected to the first rocker arm, a second end pivotably connected to the second rocker arm, and a pair of third opposed guides, each of said third opposed guides positioned to slide within a respective one of the third guide slots;

means for positioning the first and second rocker arms to move the jaws symmetrically along the first and second guide slots; and means for rotatably securing the first and second guide plates to a pipe boom such that the guide plates are rotatable about an axis substantially transverse to the guide plates.

31. The clamp of claim 30 wherein each of the first, second and third pairs of opposed guides comprises:

a lug, and first and second opposed bearing surfaces secured to the lug to contact the respective guide plate.

32. The clamp of claim 31 wherein each bearing surface is secured to the respective lug by a plurality of pins formed of the same material as the bearing surface.

33. The clamp of claim 30 wherein the bearing surfaces are formed of a plastic material.

34. The clamp of claim 33 wherein each bearing surface is secured to the respective lug by a plurality of pins formed of a plastic material.

35. The clamp of claim 30 wherein the positioning means comprises:

first and second link members, each pivotably mounted to a respective one of the rocker arms; and a pair of fourth opposed guides secured to the first and second link members to slide within a respective one of the fourth guide slots.

* * * * *

UNITED STATES PATENT AND TRADEMARK OFFICE

CERTIFICATE OF CORRECTION

PATENT NO. : 4,403,897

DATED : September 13, 1983

INVENTOR(S) : Clyde A. Willis

It is certified that error appears in the above-identified patent and that said Letters Patent is hereby corrected as shown below:

In claim 7 (column 9, line 8), delete "6" and substitute therefore --4--;

In claim 22 (column 10, line 28), delete "2" and substitute therefore --21--.

Signed and Sealed this

*Eighteenth* Day of *December 1984*

[SEAL]

*Attest:*

GERALD J. MOSSINGHOFF

*Attesting Officer*

*Commissioner of Patents and Trademarks*